United States Patent [19]

Gottschald et al.

[11] Patent Number: 4,964,239

[45] Date of Patent: Oct. 23, 1990

[54] MACHINE FOR GRINDING THE EDGES OF A LENS

[75] Inventors: Lutz Gottschald, Meerbusch; Klaus Eickmeyer, Haan, both of Fed. Rep. of Germany

[73] Assignee: Wernicke & Co. GmbH, Düsseldorf, Fed. Rep. of Germany

[21] Appl. No.: 452,613

[22] Filed: Dec. 15, 1989

[30] Foreign Application Priority Data

Dec. 17, 1988 [DE] Fed. Rep. of Germany ..... 3842601

[51] Int. Cl.[5] ..... B24B 17/00

[52] U.S. Cl. ..... 51/101 LG; 51/165.75; 51/284 E; 409/99

[58] Field of Search ..... 51/101 LG, 165.71, 165.75, 51/165.76, 165.78, 165.79, 284 R, 284 E; 409/98, 99

[56] References Cited

U.S. PATENT DOCUMENTS 2,559,431 7/1951 Hollengreen et al. ..... 51/165.75 X
2,639,562 5/1953 Balsiger ..... 51/165.75 X
3,772,829 11/1973 Asano et al. ..... 51/165.75 X
4,596,091 6/1986 Oaboudet et al. ..... 51/101 LG
4,829,715 5/1989 Langlois et al. ..... 51/101 LG

*Primary Examiner*—James G. Smith
*Attorney, Agent, or Firm*—Robert W. Becker & Associates

[57] ABSTRACT

A machine for grinding the edges of a spectacle lens, including shaft halves for holding the lens therebetween, a grinding wheel for machining the periphery of the lens, a support for the template that is held by one of the shaft halves, and a measuring head that is connected to a computer and serves for measuring the position of the front and rear sides of the lens at the grinding or contact point, in the vicinity of the periphery of the grinding wheel, relative to a prescribed plane. The measuring head has a fork-like configuration, including fork legs that are disposed parallel to one another and to the prescribed plane, and are spaced from one another by a distance that is greater than the greatest width of the periphery of the lens, whereby the shaft halves with the lens, or the grinding wheel with the measuring head, carries out an oscillating back and forth movement relative to the other.

11 Claims, 2 Drawing Sheets

MACHINE FOR GRINDING THE EDGES OF A LENS

BACKGROUND OF THE INVENTION

The present invention relates to a machine for grinding the edges or rim of a spectacle lens, including shaft halves for holding the lens therebetween, a grinding wheel for machining the periphery of the lens, a support means for a template that is held by one of the shaft means, and a measuring head that is connected to a computer and serves for measuring the position of the front and rear sides of the lens at the grinding or contact point, in the vicinity of the periphery of the grinding wheel, relative to a prescribed plane.

U.S. Pat. No. 4,596,091 and the corresponding French Patent No. 2 543 039 disclose a machine of this general type for grinding the edges of a lens that serves for providing a bevel at the edge of the lens. With this known machine, the inner and outer sides of the lens are scanned in the vicinity of the periphery of the lens by two resiliently mounted, pin-like sensors that constantly rest directly against the lens. The axial position of the sensors is communicated to potentiometers, with the values and data determined by these potentiometers being relayed to a computer or a data bank. If the scanning is effected at the same time as the grinding, the heretofore known scanning apparatus causes scratches to occur in the vicinity of the periphery of the lens as a consequence of the particles of the lens that have been ground off. In addition, when the lens is inserted between the two pin-like sensors, it is necessary to retract one of the sensors against spring force in order to provide a gap between the two sensors into which the edge of the lens can be inserted.

In contrast to the heretofore known apparatus, it is an object of the present invention to provide a machine of the aforementioned general type for grinding the edges of a lens, with the inventive machine making it possible to determine the data concerning the curve of the grinding or contact point on the periphery of the grinding wheel, which curve is described by the front and rear edge of the lens, without hereby producing scratches as occurs with the aforementioned known machine.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The inventive machine for grinding the edges of a spectacle lens is characterized primarily in that the measuring head has a fork-like configuration, including fork legs that are disposed parallel to one another and to the prescribed plane, and are spaced from one another by a distance that is greater than the greatest width of the periphery of the lens, whereby the shaft halves with the lens carry out an oscillating back and forth movement relative to the grinding wheel with the measuring head, or vice versa.

In one specific embodiment, this back and forth movement of the shaft halves and lens or the grinding wheel and measuring head has a constant amplitude of a minimum magnitude that corresponds to the spacing between the fork legs. Pursuant to another alternative, the back and forth movement has an amplitude of a magnitude that is determined by the respective position of the lens on the fork legs, with the duration of the back and forth movements of the lens or the grinding wheel being measured between the prescribed plane and the reversal points of the back and forth movement.

As a further development of the present invention, it is also desirable, at the same time that the data for the spherical curve of the lens edges is determined, to be able to utilize the full or nearly full width of the grinding wheel.

In this regard, DE-U 85 29 208 discloses a machine for grinding the edges of a lens where the grinding wheel is uniformly used up over its entire width by having the lens carry out a back and forth movement over the width of the grinding wheel, the sides of which are provided with narrow beveled abutment surfaces for the front and rear peripheral edges of the lens. In this connection, a reversing gearing is used that is load-controlled and effects a reversal of the transverse movement of the lens, so that this reversal of the movement is always effected at the same axial level of the grinding wheel width. In contrast thereto, pursuant to one specific embodiment of the present invention the parts of the scanner that effect the reversal of the back and forth movement of the grinding wheel or the lens, and that are spaced apart at a distance approximating the width of the grinding wheel, are movably disposed, with their movement transmitting not only the desired data pulse but also the reversal signal for the conclusion of one pass and the beginning of another pass of the oscillating movement of the grinding wheel or the lens.

Further specific features of the present invention will be described in detail subsequently.

DESCRIPTION OF PREFERRED EMBODIMENTS

Figure 1:
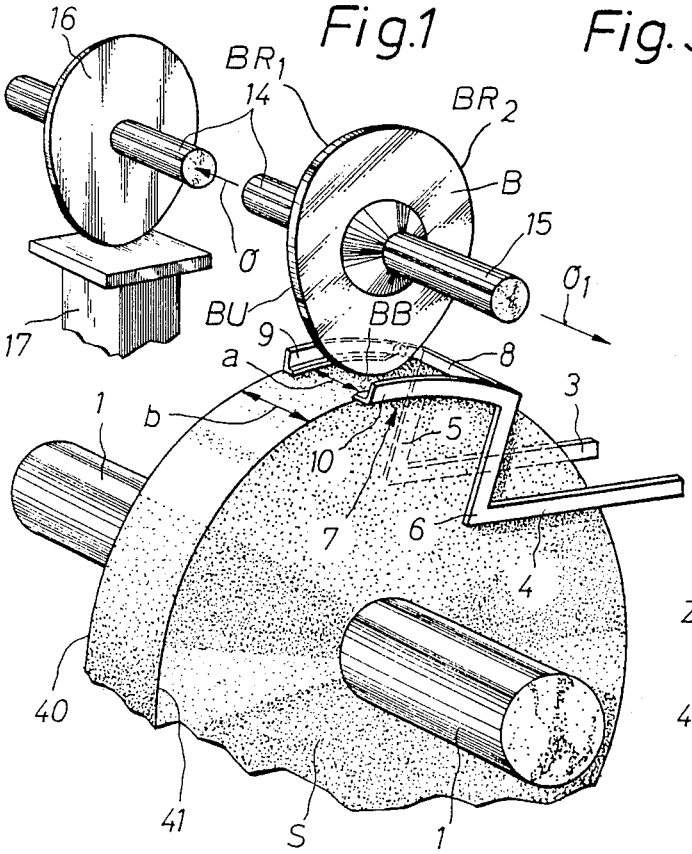
FIG. 1 is a perspective view of the upper side of a grinding wheel on which are disposed a measuring head and the lens.
Figure 3:
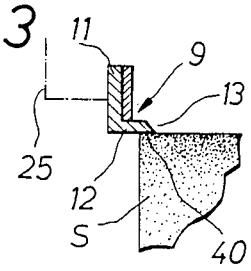
FIG. 3 shows the position of a fork leg of the measuring head relative to the adjacent rim of the grinding wheel.
Figure 2:
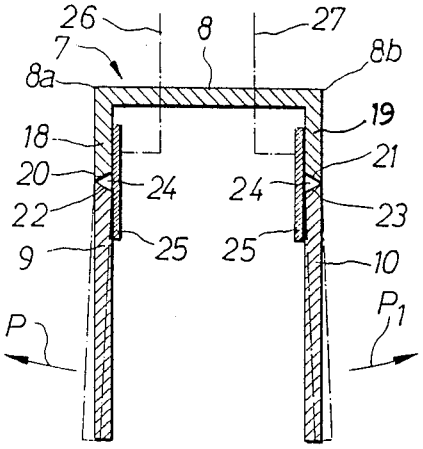
FIG. 2 is a first exemplary embodiment of the inventive fork-like measuring head.

Referring now to the drawings in detail, in the illustrated embodiment, the machine for grinding the edge of a spectacle lens includes a grinding wheel S that is fixedly disposed on the shaft 1, which can be shifted longitudinally and serves to rotate the grinding wheel. In the embodiment of FIGS. 1 to 3, provided on both sides of the grinding wheel S on a non-illustrated wall of the machine housing are two parallel rods or bars 3, 4 that merge with further rods or bars 5, 6 that extend approximately perpendicular thereto. Disposed at the end of this second pair of bars 5, 6 is a fork-like measuring head that is indicated in general by the reference numeral 7 and comprises a crossmember 8 and two parallel fork legs 9, 10 that in their starting position are spaced from one another by a distance "a" that is approximately equal to the width "b" of the grinding wheel S. As shown in FIG. 3, the legs 9, 10 have an upper portion 11 that has a rectangular cross-sectional configuration and to which is connected a narrow base portion 12 that extends from the upper portion 11 in the direction toward the central plane M of the grinding wheel S (see FIGS. 4 and 5). The forward edge 13 of the base portion 12 is either pointed at an acute angle or is slightly rounded off, with a very small gap being left between the base portion and the grinding wheel.

The spectacle lens B is held in a known manner between two shaft halves 14, 15 of the machine and is rotated thereby. Fixedly disposed on the shaft half 14 is the template 16, which rests upon a support member 17.

As shown in FIG. 2, the crossmember 8 of the measuring head 7 is provided with two short extensions 18, 19 that end in respective inclined edges 20, 21. Disposed across from each of these edges 20, 21 is a corresponding inclined edge 22, 23 of the legs 9, 10, whereby between each of the pairs of edges 20, 22 and 21, 23 a respective vertical gap 24 is formed that has a triangular cross-sectional configuration. Disposed between the extensions 18, 19 and the adjacent end of the legs 9, 10 is a respective measuring strip 25. When these measuring strips 25 stretch as a consequence of the deflection of the legs 9, 10 in the direction of the arrows P and $P_1$ out of their starting position, in which they are parallel to one another, a signal is transmitted via a line 26, 27 to a non-illustrated computer and register that are generally known for such purposes.

In the illustrated embodiment, the lens B along with the two shaft halves 14, 15 carry out a repetitive, uniform oscillating movement in the direction of the arrows O and $O_1$ in FIG. 1. Conversely, the shaft halves 14, 15 for the lens can be fixed in a longitudinal direction, and the grinding wheel S can carry out oscillating transverse movements, with the fork-like measuring head 7 then following this oscillating movement of the grinding wheel. These axial oscillating movements of the shaft halves or of the grinding wheel can be effected with the aid of means familiar to anyone skilled in the art, such as a reversing motor that has a shift dog.

The rotational movement of the lens B and the oscillating movement of the lens or of the grinding wheel, which oscillating movement is carried out at a constant speed, are coordinated with one another in such a way that the oscillating movements repeat themselves over approximately the width of the grinding wheel in conformity with a specific angular rotational movement of the shaft halves. This can be effected with a speed-measuring device of the lens shaft halves and with the reversing motor for the shaft halves or the grinding wheel. At the end of each oscillating transverse movement of the lens B over the approximate width of the grinding wheel S, the edge of the front or rear side of the lens B contacts one of the legs 9, 10 and slightly deflects the same in the direction of the arrow P or $P_1$.

Figure 7:
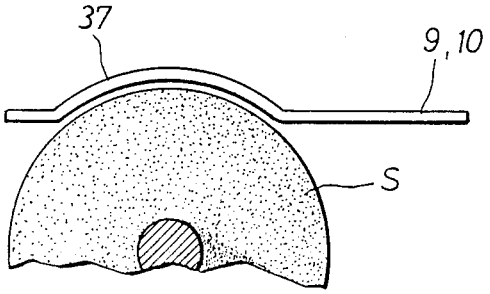
FIGS. 6 to 8 show further advantageous exemplary embodiments of the inventive fork-like measuring head.

The fork legs 9, 10, which can have a contour that is adapted to the periphery of the grinding wheel (FIG. 7), transmit via the measuring strips 25 not only the control signal for reversing the oscillating movement, but with the aid of these measuring strips spacing data concerning the contact points BB of the front or rear edge $BR_1$ and $BR_2$ (FIG. 1) of the lens edge or rim surface BU with the legs 9, 10 are also determined. By coordinating this data to the angle values of the lens rotation, the shape of the spherical curve of the lens edges $BR_1$ and $BR_2$ of the front and rear sides of the lens can be determined.

Figure 4:
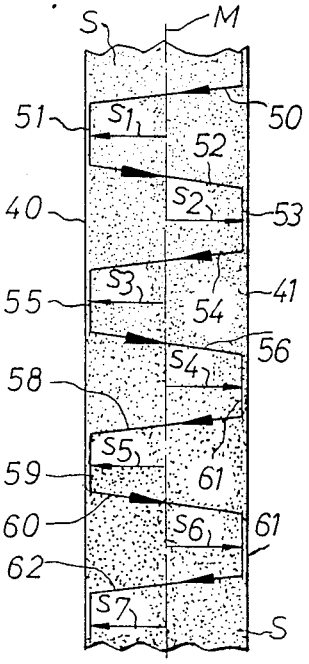

FIG. 4 schematically illustrates the path of individual contact points BB of the rim surface BU of the lens with the grinding wheel periphery (which is unrolled or laid flat in the plane of the drawing), and hence illustrates the path of this contact point over the approximate width "b" of the grinding wheel S. FIG. 4 is based on the contact point of the front side of the lens B with the grinding wheel S first covering the path 50 over the grinding wheel S and thereafter, prior to reversing the oscillating movement to the path 52, covering the path portion 51 which, to facilitate illustration, is greatly enlarged in the drawing. After conclusion of the path 52, the back side of the lens abuts against the fork leg 10, deflecting the same out of its starting position. After covering the path portion 53, the contact point BB of the lens B moves on the grinding wheel S over the path 54 and the further path portion 55, etc. The contact point now moves over the paths 56, 58, 60, 62, and the path portions 57, 59, 61, etc.

Figure 5:
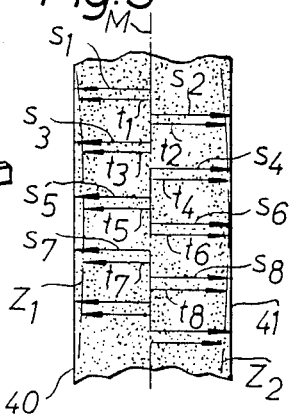
FIGS. 4 and 5 diagrammatically illustrate the path of the contact point of the lens with the grinding wheel and the distance of this point from the neutral line (the central plane of the grinding wheel)

The data relating to the spherical curve of the front and rear edge of the lens can be determined and stored in various ways. In a first possibility, the distances $s_1$ to $s_7$ (in conformity with the paths 50, 52, 54, 56, 58, 60, 62) of the lens contact point with the wheel S from a central line M, which is disposed in the central plane of the grinding wheel S, is kept uniform and constant, i.e. the reversal of the oscillating movement is always effected at the same level on the wheel periphery in the vicinity of the two edges 40, 41 of the grinding wheel (FIGS. 1, 3, and 4). Upon contact and start of the deflection movement of the fork legs 9, 10, a control signal is transmitted to the computer. The computer stores the period of time that the contact point BB of the lens B needs with the grinding wheel S (FIG. 1) over each individual path 50 to 62, i.e. the distances $s_1$ to $s_7$, and calculates therefrom the position of the successive contact points, which are the points of the spherical curve of the front and rear edges $BR_1$ and $BR_2$ of the lens, which curve is to be determined. In FIG. 5, the paths $s_1$ to $s_7$, and the times $t_1$ to $t_7$ associated therewith, are illustrated. The thus-obtained time curves $Z_1$ and $Z_2$ symbolize the spherical curves of the edges $BR_1$ and $BR_2$ of the front and rear sides of the lens. From the above it is clear that it makes no difference for the relative movement between the lens and the grinding wheel which of these two components carries out the oscillating movement.

Another possibility for obtaining and storing data relative to the spherical curves of the edges of the lens relates to determining the amount of deflection of the measuring strips 25. In this instance, the various path magnitudes of the deflection of the measuring strips 25 yield the spherical curve values without the need to convert the time. In this connection, the reversal of the oscillating movement is effected via a timing relay at periodic intervals after the first contact of the fork legs 9, 10, i.e. after the first deflection pulse of the legs and after the deflection of the fork leg has been completely carried out and terminated.

Figure 6:
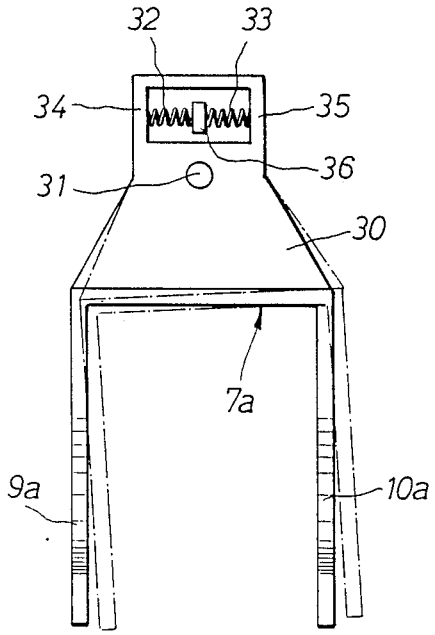

In the embodiment of the measuring head *7a* illustrated in FIG. 6, the fork legs *9a, 10a* of the measuring head are rigidly disposed on a crossmember 30 of the head that is pivotable about a pin 31 which, along with the fork legs, is always returned to the starting position via two springs 32, 33 that are disposed between the portions 34, 35 and a stationary part 36.

FIG. 7 once again illustrates the preferred curved configuration 37 of the fork legs 9, 10 in adaptation to the periphery of the grinding wheel S. Here also the spherical curve of the lens periphery can be determined over time or the path of the deflection.

Figure 8:
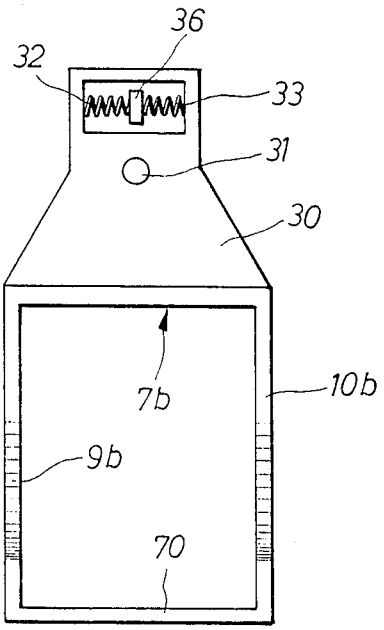

FIG. 8 shows a further specific embodiment of a measuring head *7b*, the crossmember 30 of which has the same configuration and arrangement as in the embodiment of FIG. 6, while the fork legs *9b*, *10b* are rigidly interconnected by a crosspiece 70.

The present invention is, of course, in no way restricted to the specific disclosure of the specification and drawings, but also encompasses any modifications within the scope of the appended claims.

What we claim is:

1. In a machine for grinding the edges of a spectacle lens, including shaft halves for holding said lens therebetween, a grinding wheel for machining the periphery of said lens, a support means for a template that is held by one of said shaft halves, and a measuring head that is connected to a computer and serves for the measurement of the position of the front and rear sides of said lens at the grinding or contact point, in the vicinity of the periphery of said grinding wheel, relative to a prescribed plane, the improvement wherein:

said measuring head has a fork-like configuration, including fork legs that are disposed parallel to one another and to said prescribed plane, and are spaced from one another by a distance that is greater than the greatest width of the periphery of said lens, whereby said shaft halves, with said lens, carry out oscillating back and forth movements relative to said grinding wheel, with said measuring head, or vice versa.

2. A machine according to claim 1, in which said fork legs are movable in a direction transverse to said prescribed plane, with said spacing between said legs corresponding approximately to the width of said grinding wheel.

3. A machine according to claim 1, in which said fork legs are interconnected via a crossmember in such a way that they are resiliently deflectable from one another, whereby in the vicinity of said crossmember, said fork legs are provided with means for measuring the point in time, or the point in time and the magnitude, of deflection of said legs.

4. A machine according to claim 3, in which said measuring means is a measuring strip.

5. A machine according to claim 4, in which said measuring head is held in place relative to said grinding wheel via support members that are non-rotatably mounted on both sides of said grinding wheel.

6. A machine according to claim 4, in which each of said fork legs, in the vicinity of said measuring strip, is provided with a V-shaped gap that is open in a direction toward said measuring strip.

7. A machine according to claim 1, in which said fork legs of said measuring head are fixedly connected with a crossmember that is pivotable about a pin that extends transverse to said shaft halves.

8. A machine according to claim 7, in which said crossmember is provided with two opposed springs that are disposed between a stationary part and two further portions of said crossmember.

9. A machine according to claim 8, in which said fork legs, remote from said crossmember, are interconnected by a rigid crosspiece.

10. A machine according to claim 1, in which said back and forth movements of said shaft halves and lens, or of said grinding wheel and measuring head, have a constant amplitude with a minimum magnitude that corresponds to said spacing between said fork legs.

11. A machine according to claim 1, in which said back and forth movements of said shaft halves and lens, or of said grinding wheel and measuring head, have an amplitude of a magnitude that is determined from the respective position of said lens on said fork legs, and the duration of said back and forth movements is measured between said prescribed plane and the reversal points of said back and forth movements.

* * * * *